US008245983B2

(12) United States Patent
Gilbertson

(10) Patent No.: US 8,245,983 B2
(45) Date of Patent: Aug. 21, 2012

(54) SYSTEM AND METHOD FOR RAILROAD WAYSIDE MONITORING

(75) Inventor: Keith Gilbertson, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 758 days.

(21) Appl. No.: 11/651,229

(22) Filed: Jan. 9, 2007

(65) Prior Publication Data

US 2008/0164380 A1 Jul. 10, 2008

(51) Int. Cl.
*B61L 3/22* (2006.01)

(52) U.S. Cl. ..... 246/167 R; 246/169 R

(58) Field of Classification Search ..... 246/169 R, 246/169 A, 169 D, 169 S, 167 R, 187 B, 246/182 R, 2 R, 4, 6, 23, 62
See application file for complete search history.

(56) References Cited

U.S. PATENT DOCUMENTS 5,136,516 A * 8/1992 Twombly ..... 701/20
5,358,202 A * 10/1994 Tse et al. ..... 246/34 R
5,785,283 A * 7/1998 Ehrenberger et al. ..... 246/62
5,950,966 A * 9/1999 Hungate et al. ..... 246/62
6,867,708 B2 * 3/2005 Darby et al. ..... 340/933
2002/0004693 A1 * 1/2002 Collins ..... 701/19
2005/0143874 A1 * 6/2005 Peltz et al. ..... 701/19
2007/0241237 A1 * 10/2007 Foy et al. ..... 246/167 R
2008/0164380 A1 * 7/2008 Gilbertson ..... 246/167 R

* cited by examiner

*Primary Examiner* — S. Joseph Morano
*Assistant Examiner* — Jason C Smith
(74) *Attorney, Agent, or Firm* — GE Global Patent Operation; John A. Kramer

(57) ABSTRACT

A system and method for communicating information between wayside equipment and a railcar is provided, wherein the communication system includes a wayside monitoring system located at the wayside of a railway, wherein the wayside monitoring system is configured to generate wayside system data responsive to an operational characteristic of the railcar. A wayside communication device communicated with the wayside monitoring system to receive the wayside system data is also provided, wherein the wayside communication device is configured to generate digital wayside data and transmit at least one of the wayside system data and the digital wayside data to the railcar via a dispatch voice channel. Furthermore, an on-board communication device is provided, wherein the on-board communication device is configured to receive the digital wayside data from the wayside communication device via the dispatch voice channel.

13 Claims, 8 Drawing Sheets

600

SYSTEM AND METHOD FOR RAILROAD WAYSIDE MONITORING

FIELD OF THE INVENTION

The present invention relates generally to monitoring the components of a railroad car traveling in a train and more particularly to an improved system and method for transferring information between wayside equipment and a railroad car in a train.

BACKGROUND OF THE INVENTION

As is known, railroad cars have been used to transport everything from commerce, such as goods and products, to military hardware, such as weapons and supplies, to people all around the country and all around the world. In fact, railway transportation is so important that a large portion of the economy relies on the railways as a mode of transportation to safely transport people between destinations and to safely deliver goods and materials to manufacturers and distributors. As such, any disruption in this service creates a ripple effect that can be felt throughout the economy. Thus, in order to avoid disruption of the railway service as well as to maintain a safe environment for railroad personnel and railroad passengers, it is essential that all key components of the railroad cars are maintained in safe and proper working condition. It is important that key components of the railroad cars are monitored to identify any existing conditions or potential conditions that might cause a failure of a railroad car component resulting in a loss of life or in the possible damage to the train and its cargo, as well as a failure of the train to meet its intended delivery schedule.

In order to accomplish this task, detector systems are typically positioned along the rails to monitor and detect the operational condition of the railroad cars as they past the detectors. Each time a train passes these detector systems, typically classified as Wayside Equipment, the detector systems communicate information responsive to the operational condition of the railroad car to an operational office via a phone line or to the train crew via a VHF radio that interfaces with the Wayside Equipment over the "dispatch channel" used for that territory. The dispatch channel is the communications channel (i.e. frequency) that the locomotive crew has their VHF radio tuned to so that they can hear directions from the railroad dispatcher. For example, one type of detector system currently in use is a Hot Bearing/Hot Wheel (HB/HW) detector system. Referring to FIG. 1, a Hot Bearing/Hot Wheel (HB/HW) detector system 100 in accordance with the prior art is shown, wherein the HB/HW detector system 100 includes at least one detector apparatus 102 that is communicated with a central office 104 and with the train crew via a voice radio 106. The detector apparatus 102 analyzes the condition of the bearings and/or wheels of the passing railcars (e.g. for "hot spots") and broadcasts any detected defects to the train crew via the voice radio 106. Any additional alarms and/or data may also be communicated back to a central office 104. Additionally, various other types of detectors may be connected to the unit, such as a dragging equipment detector or other detectors that typically provide simple contact closures.

Another type of detector system currently in use is a "talker system." Referring to FIG. 2, a "talker system" 200, in accordance with the prior art, is a defect detector system 200 that includes one or more detection devices 202, wherein the detection devices 202 typically provide contact closures when a defect is detected. The defect unit then reports the defect to the train crew typically by broadcasting the alarm over the voice radio 106. As above, any additional alarms and/or data may also be communicated back to the central office 104. This type of "talker system" 200 differs from that in FIG. 1 in that the "talker system" does not typically include a hot bearing or hot wheel scanner. Still another type of detector system currently in use includes an HB/HW detector system 100 that is integrated with an AEI Tag Reading system. Referring to FIG. 3, HB/HW detector system 100 integrated with an AEI Tag Reading system 108 in accordance with the prior art is shown, wherein AEI tag readers obtain car ID information by reading an ID tag that is affixed to each railcar. This car ID information can then be used to better locate a defect, such as a hot bearing or hot wheel. Additionally, the car ID information could be used to more efficiently locate a defect rather than trying to identify the location of the defect by counting the axles. Moreover, actual scanned heat data for each wheel bearing on a railcar can be associated with a particular railcar to allow better analysis of the railcar bearings to order to better predict when they are going to fail. This allows bearings that have typically higher temperatures to be tracked even though they are below the alarm threshold.

Referring to FIG. 4, current detector systems commonly have two methods or links for communicating information. One communication path is to transmit data to a central or local office and may be accomplished via any established network, including telephone lines, wireless networks, cell phones, Ethernets, etc. Data can be sent to the office locations and can include everything from the most recent detection information to the entire train log with complete thermal data collected from the train, to alarm and/or diagnostic data. However, in alarm situations, this "data" link is not adequate to identify an emergency situation and take necessary action to prevent a possible disaster. Another communication path is to transmit data directly to the onboard train crew. This is typically accomplished by the detectors transmitting a synthesized voice or recorded voice message via a VHF voice radio as the train passes, wherein the message includes the name of the railroad, the location of the detector, the type of detector and the Alarm status (i.e. summary result of the train analyzed . . . such as "No Defects Detected"). Moreover, alarm messages may typically contain additional information, such as side and axle location for Hot Wheel or Hot Bearing detectors. This broadcast can take any where from 10 to 45 seconds even if there are no alarms.

Referring again to FIG. 4, a typical interface between the defect detector unit and a voice radio in accordance with the prior art is shown. To effect a radio transmission, the defect detector unit activates a "Push-To-Talk" or similar interface line of a standard radio to put the radio into transmit mode, thus enabling the radio microphone or other modulation input. The defect detector unit then plays back the appropriate recorded or synthesized voice message and applies the message to the radio modulation input. This "voice" message is then transmitted from the wayside radio to its intended destination. The wayside radio is configured to monitor a main or "road" frequency used by the dispatcher to communicate to the onboard train crew via the radio installed on the locomotive. The onboard train crew will then hear the broadcast message across the radio speaker and appropriate action will be taken if required. It should be appreciated that some radios have a "busy" indication (identified as "busy" on the block diagram of FIG. 4), which is an output from the radio that indicates that the radio channel is busy. The defect detector system will use this to inhibit radio broadcast until the channel is clear. Moreover, some systems can be equipped with a "re-broadcast" function. If the on-board train crew did not hear or understand a radio broadcast, this function allows the train crew operator to transmit a sequence of Dual Tone Multi-Frequency (DTMF) tones, as capable from standard locomotive radios, to the wayside radio to trigger a re-broadcast signal to the defect detector unit causing the defect detector unit to repeat the last radio transmission.

One reason that radio broadcasting is used is that it currently provides the quickest and easiest method to ensure that proper action is taken in an emergency situation. For example, each time the train passes the defect detector equipment, the broadcast allows the crew the opportunity to validate the proper operation of the equipment, including the radio system. In fact, on many railroads, the train crews are required to have their radios set to monitor the broadcast channels from the dispatch in order to "hear" the broadcast and to validate that the detector and radio system are working. Thus, when the train passes the defect detector equipment, the crew verifies that they heard the defect detector equipment broadcast a recorded message. Upon hearing this message, the crew validates that the defect detector system (including the radio system) is operating normally. If the crew receives a message from the defect detector system that indicates a malfunction on the railroad train, the crew then takes appropriate action. For example, the operational status information may include wheel axle numbers and position (left/right), so that in the event that HOT bearing is detected, the crew could be directed to the axle location on the train for inspection. In fact, most operating rules dictate that if a Hot Bearing Alarm is identified, the train needs to be stopped and the bearing inspected to determine if the car needs to be cut out or if safe to proceed.

One disadvantage with the current system is that due to the need to more closely monitor railroad equipment along critical rail lines, the number of defect detectors installed along the rails has increased substantially. Unfortunately, this increase in the number of detectors installed along the wayside has had a negative impact on the amount of available "Air Time" a dispatcher has to communicate with the train crews. In fact, more and more of the available dispatch radio channel bandwidth is being used up and as such dispatchers are not able get airtime with all of the detectors broadcasting. For example, the defect detector equipment is typically set to broadcast directly to the crews each time the train passes, not just when the defect detector equipment has detected a problem. The increased number of defect detectors (e.g. every 10 miles instead of every 50 miles), the increased miles of double track lines and an increase in train traffic all cause an increase in the number of radio transmissions (the typical normal transmission takes about 30 second of air time) which results in a reduced amount of available air time for the dispatcher to talk to the trains.

This "radio congestion" is undesirable due for a number of reasons. First, the increased radio traffic may result in messages being transmitted well after the train has passed the defect detector equipment. Second, the increased radio traffic may result in lost or partial messages. If simultaneous message transmissions are occurring the train crew may only receive a portion of the message or the train crew may not hear the message at all. In an attempt to reduce the number of radio transmissions from the defect detector radios, some railroads have gone to exception reporting. This is where the systems no longer broadcast messages to each passing train, but only to those that have an alarm condition. Although this has been successful in reducing the number of radio transmissions, it creates a secondary problem in that, as discussed hereinabove, the broadcast of non-alarm messages are used to validate the proper operation of the system where engine crews report detector locations that do not broadcast as they pass as defective so that they may be repaired.

SUMMARY OF THE INVENTION

A communication system for communicating information between wayside equipment and a railcar is provided, wherein the communication system includes a wayside monitoring system located at the wayside of a railway and wherein the wayside monitoring system is configured to generate wayside system data responsive to an operational characteristic of the railcar. A wayside communication device communicated with the wayside monitoring system to receive the wayside system data is also provided, wherein the wayside communication device is configured to generate digital wayside data and transmit at least one of the wayside system data and the digital wayside data to the railcar via a dispatch voice channel. Furthermore, an on-board communication device is provided, wherein the on-board communication device is configured to receive the digital wayside data from the wayside communication device via the dispatch voice channel.

A method for communicating wayside digital data between a wayside monitoring system and an on-board communication device disposed on-board a railcar is provided and includes generating wayside system data responsive to at least one operational characteristic of a railcar and creating digital wayside data responsive to at least a portion of the wayside system data. The method further includes identifying whether the on-board communication device is configured for digital communication, wherein if the on-board communication device is configured for digital communication, the digital wayside data is transmitted to the on-board communication device, and if the on-board communication device is not configured for digital communication, the wayside system data is transmitted to the on-board communication device. Additionally, the method includes communicating at least one of the digital wayside data and the wayside system data to on-board crew.

A communication system for communicating information between a wayside monitoring system and a railcar traveling on a railway, wherein the wayside monitoring system generates analog wayside system data responsive to an operational characteristic of the railcar is provided, wherein the communication system includes a wayside communication device communicated with the wayside monitoring system to receive the analog wayside system data, wherein the wayside communication device is configured to generate digital wayside data responsive to the analog wayside system data and transmit at least one of the analog wayside system data and the digital wayside data via a dispatch voice channel and an on-board communication device, wherein the on-board communication device is configured to receive the at least one of the analog wayside system data and the digital wayside data via the dispatch voice channel.

BRIEF DESCRIPTION OF THE FIGURES

The foregoing and other features and advantages of the present invention will be more fully understood from the following detailed description of illustrative embodiments, taken in conjunction with the accompanying drawings in which like elements are numbered alike in the several Figures.

DETAILED DESCRIPTION OF THE INVENTION

Figure 1:
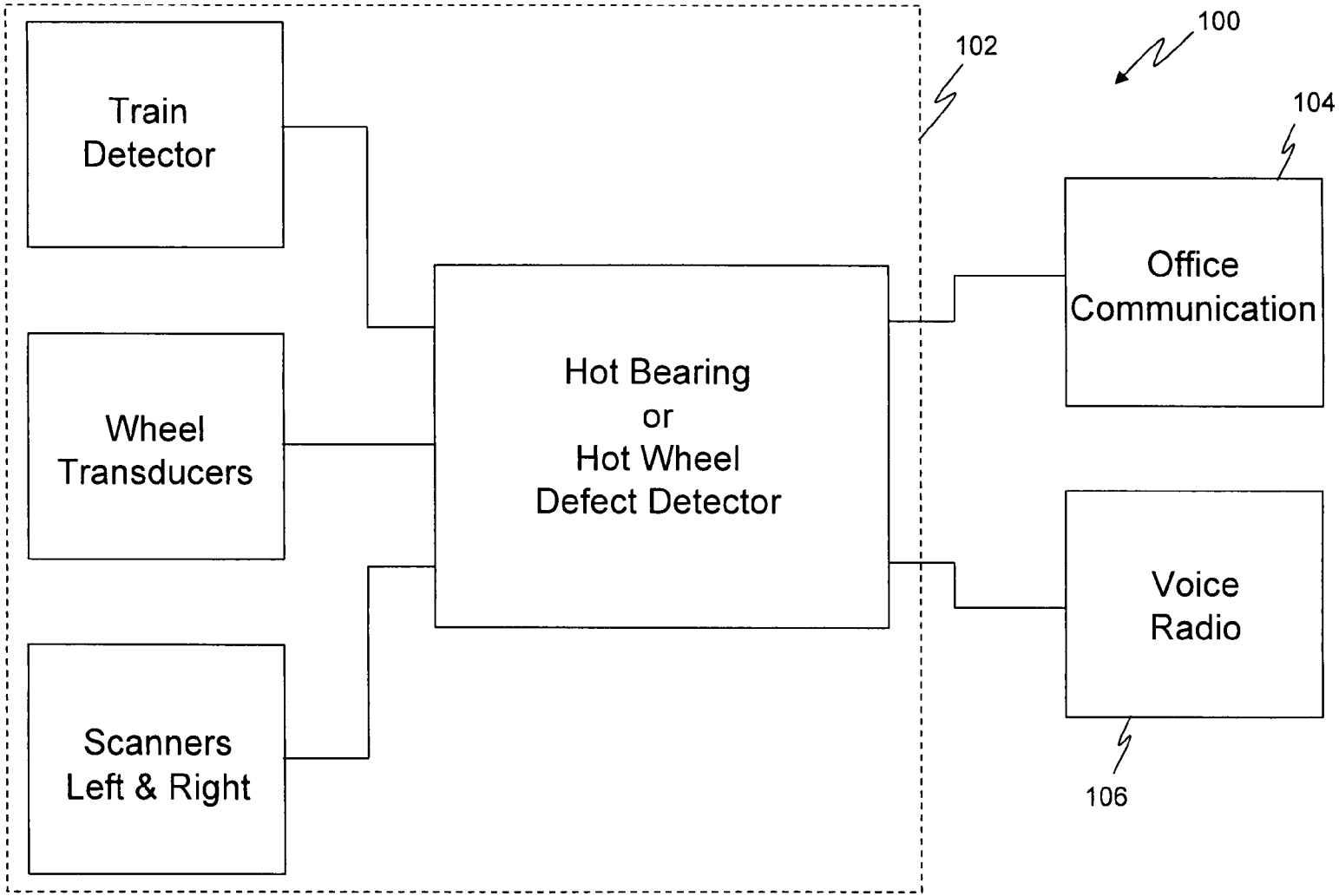
Figure 1 Prior Art
FIG. 1 is a schematic block diagram of a typical Hot Bearing/Hot Wheel Detector System, in accordance with the prior art.
Figure 2:
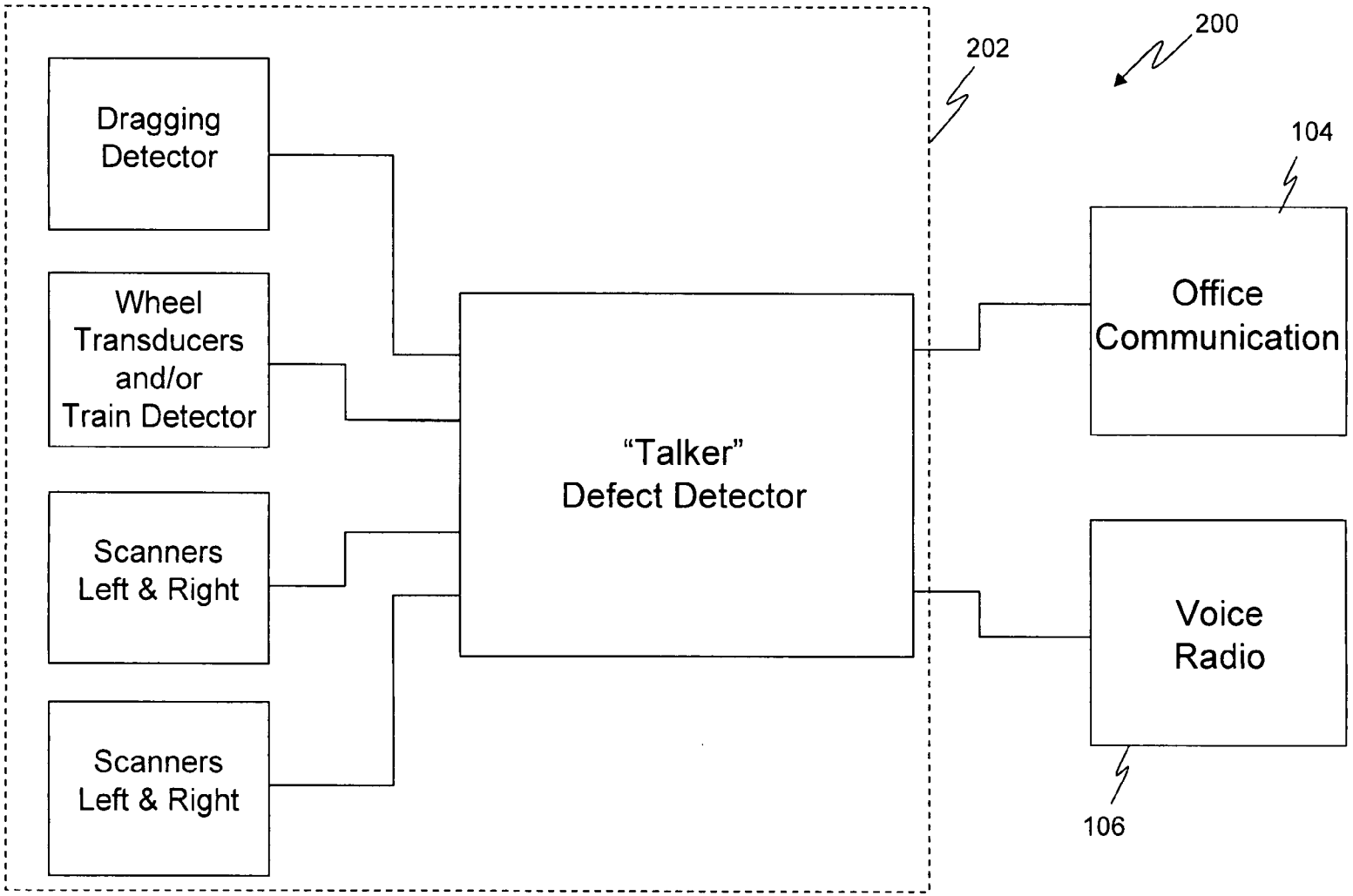
Figure 2 Prior Art
FIG. 2 is a schematic block diagram of a typical "Talker" Detector System, in accordance with the prior art.
Figure 3:
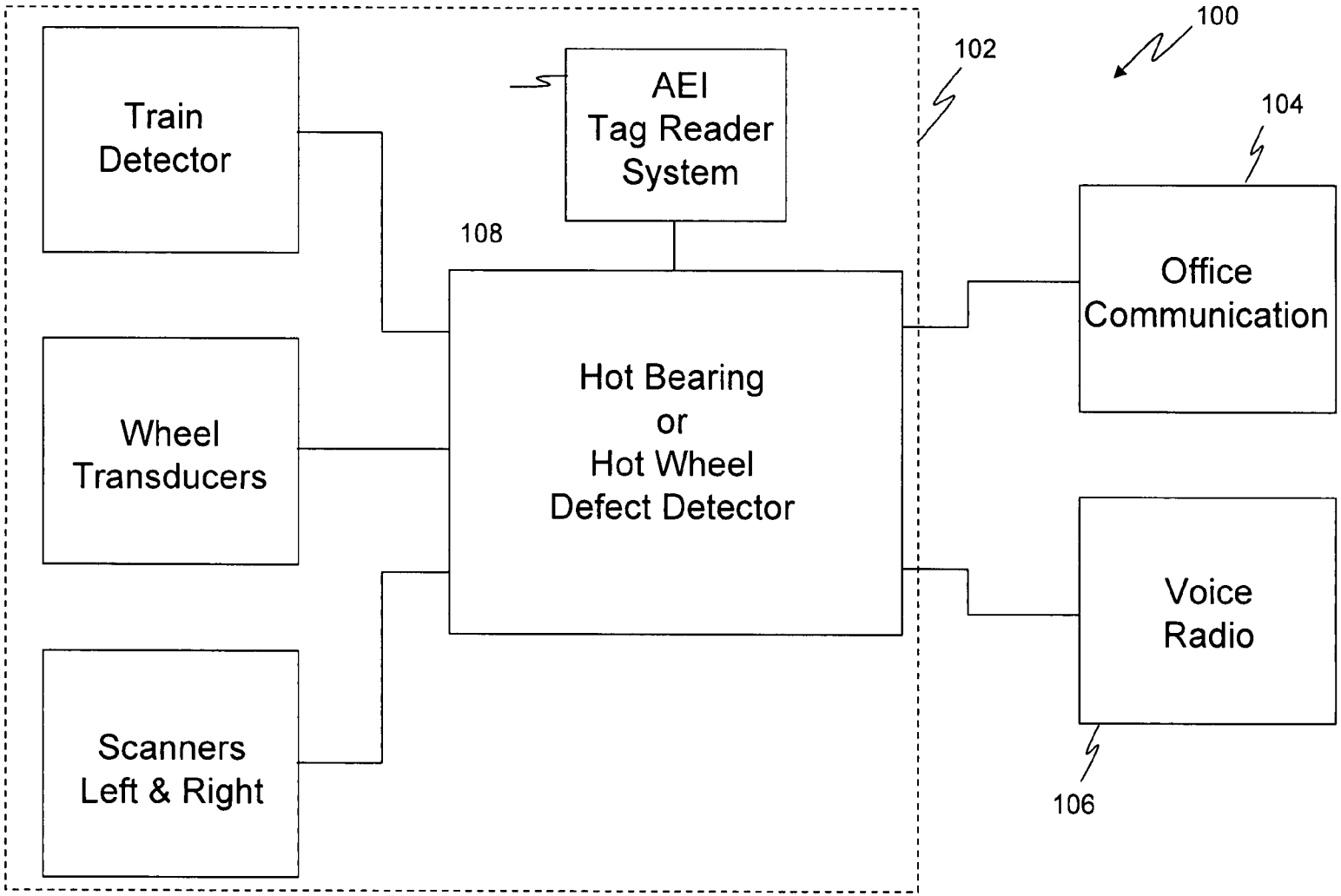
Figure 3 Prior Art
FIG. 3 is a schematic block diagram of the Hot Bearing/Hot Wheel Detector System of FIG. 1 communicated with an AEI Tag Reader System, in accordance with the prior art.
Figure 4:
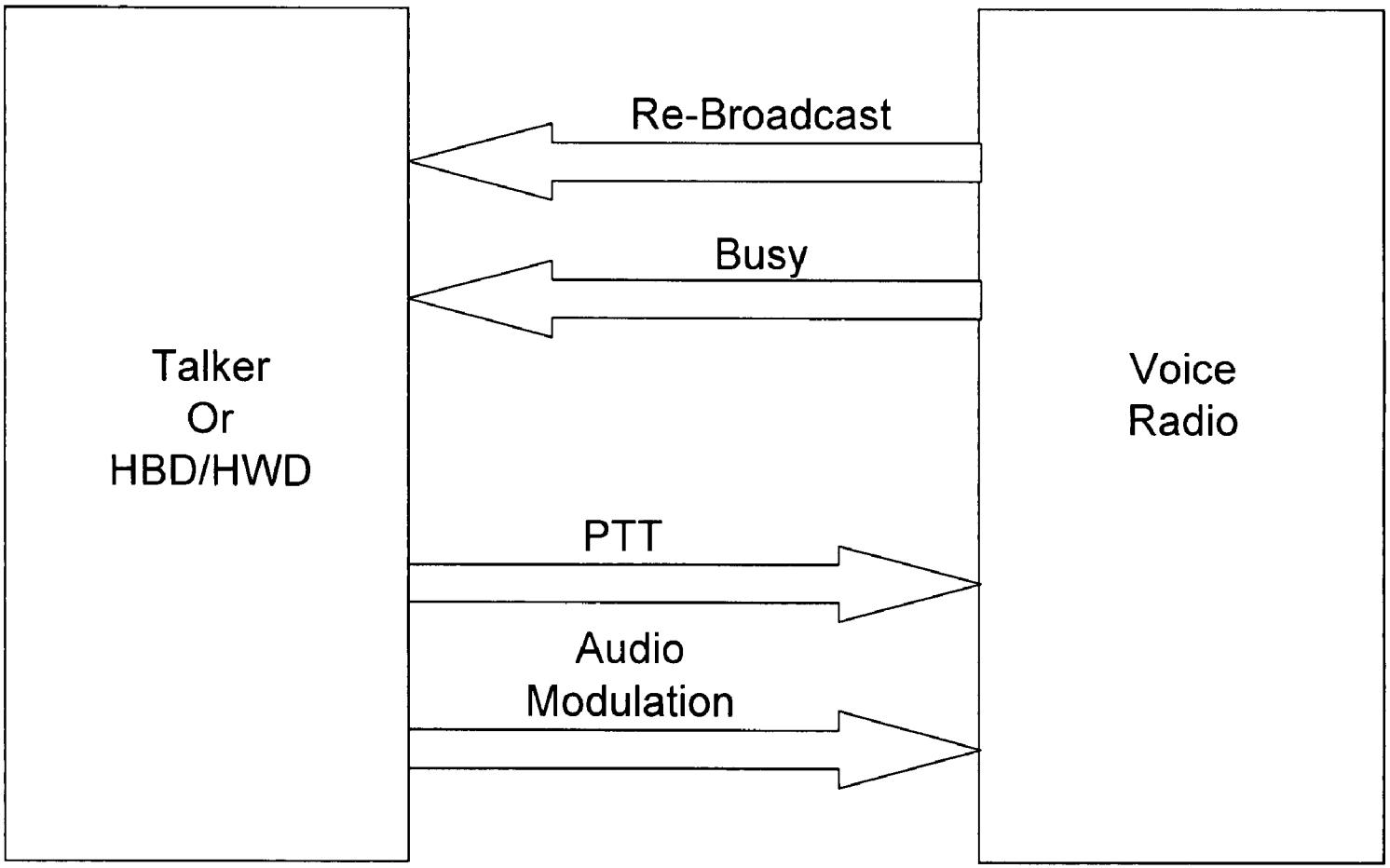
Figure 4 Prior Art
FIG. 4 is a schematic block diagram of a typical radio interface between the defect detector system and the on-board locomotive voice radio of the detector system of FIG. 1 and/or FIG. 2, in accordance with the prior art.
Figure 5:
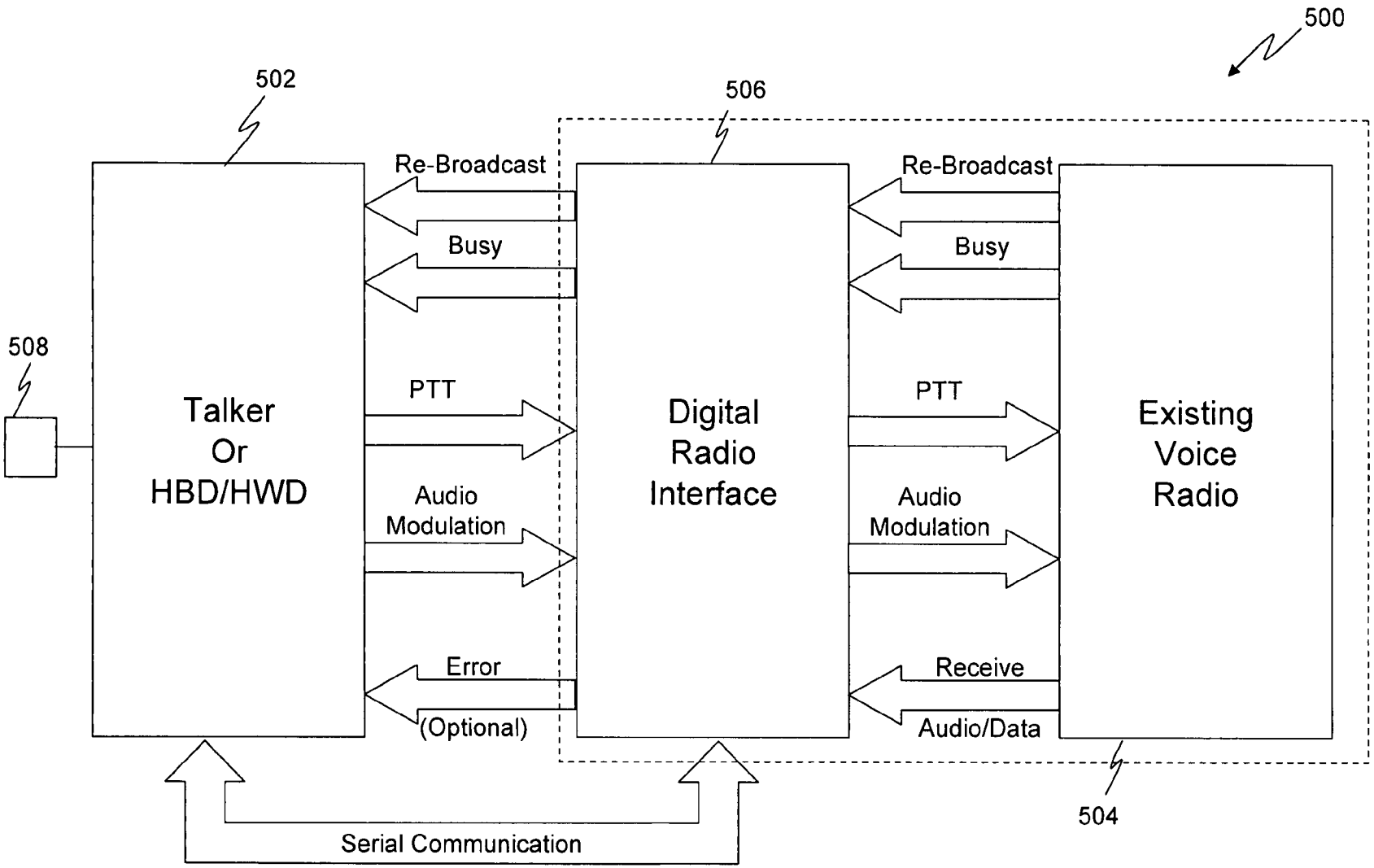
FIG. 5 is a schematic block diagram of a defect detector system capable of digital communication, in accordance with a first embodiment of the present invention.
Figure 6:
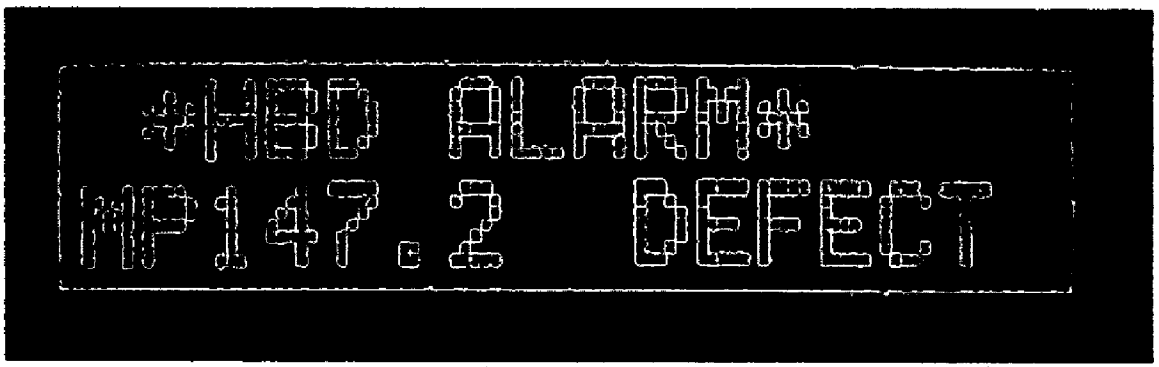
FIG. 6 is a front view of one embodiment of a digital display device for displaying digital messages to an on-board train crew, in accordance with the present invention.

In accordance with the present invention, a system and method which allows for the transfer of both digital and analog information, such as messages and/or alarms, between the wayside defect detection equipment and the on-board train crew is provided. As discussed in more detail hereinafter, this communication may be accomplished via at least one of two (2) ways. Referring to FIG. 5, one way this may be accomplished is to upgrade the current wayside radio system and/or the current on-board locomotive radio system to be capable of digital communication, i.e. have the capability to transmit and/or receive digital data. In this situation, the analog message data generated for transmission by the wayside radio system is converted into digital format and transmitted to the on-board locomotive radio via the voice channel currently used by the dispatcher. The digital message data may then be communicated to the on-board train crew via digital and/or analog means, such as either a digital display 600 (as shown in FIG. 6) and/or an audio enunciation device.

Figure 7:
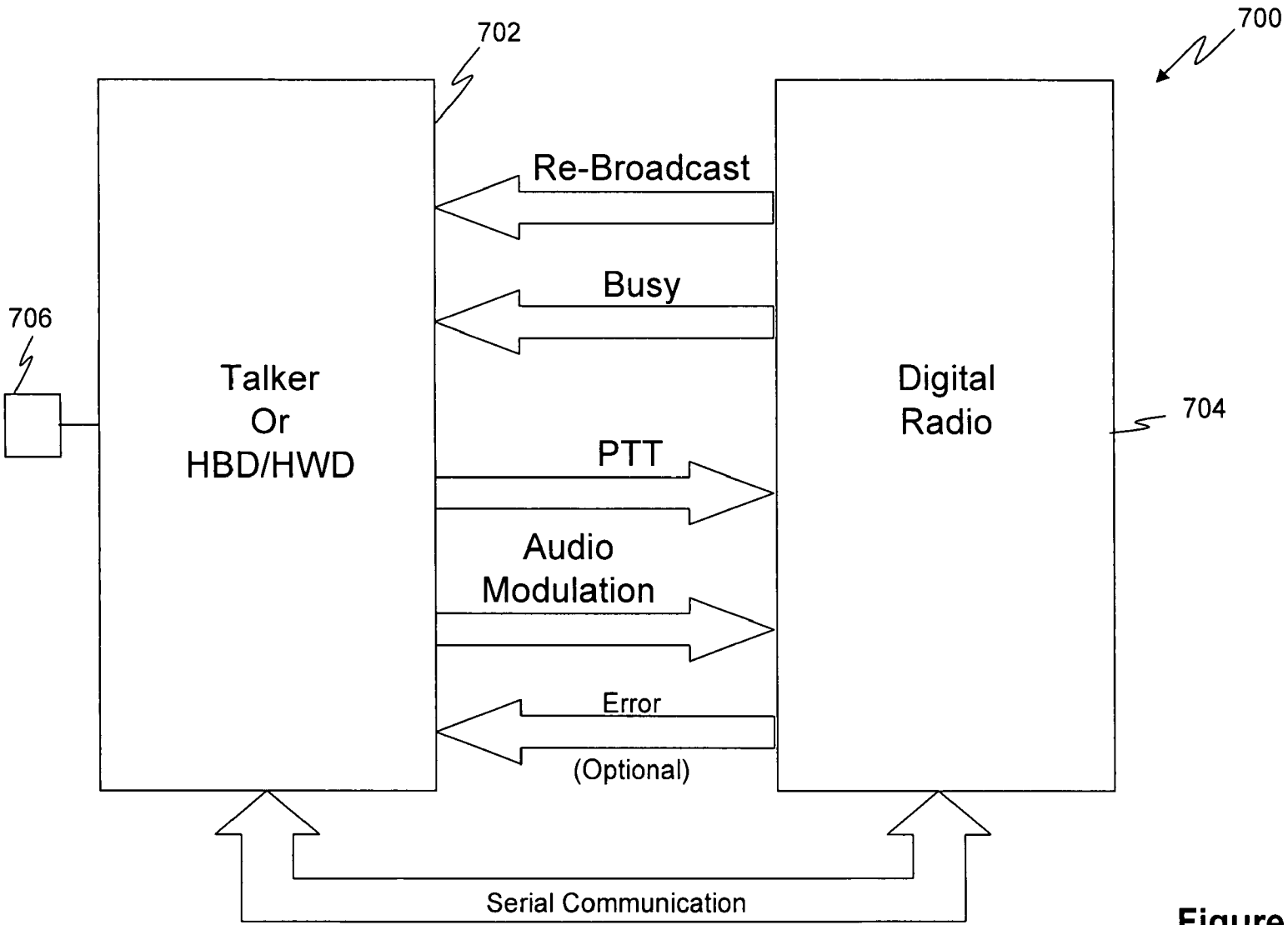
FIG. 7 is a schematic block diagram of a defect detector system capable of digital communication, in accordance with a second embodiment of the present invention.

Referring to FIG. 7, another way this may be accomplished is to replace the existing key wayside defect detection equipment and/or the on-board locomotive radio with new equipment that is capable of supporting digital communications. It should be appreciated that the system and method of the present invention not only allows for reduced airtime on congested dispatch radio channels since digital broadcast takes much less time than a voice transmission, but it also eliminates or reduces the possibility of misunderstood broadcasts and the consequential necessity of having to initiate the re-broadcast of information. Additionally, the present invention provides the capability to "store" messages for recall to re-check information sent, such as the side and axle location of an alarm. Moreover, messages could also be retained for review when the train pulls into a rail yard and/or enters service for maintenance allowing for the generation of trend data related to either train components and/or wayside equipment. Thus, collected wayside information can be saved or retained onboard the locomotive or be transferred to a data management system. This data can then be downloaded when the locomotive gets to a yard where high-speed data downloading systems are typically available.

The existing system(s) can be easily upgraded to provide digital and/or analog capability allowing the existing systems to be easily migrated from analog voice to digital messaging. In this situation, the system can be configured to selective broadcast traditional analog voice information and/or digital information as desired, such as after confirmation that a passing train is digitally equipped. As such, the present invention contemplates that the system can be configured to handle both analog as well as digital transmissions so that the crew members of trains that are digitally capable and trains that are not digitally capable can both hear and/or see the information.

It should be appreciated that the digital messaging system of the present invention may also be backward compatible with the current analog voice systems, thus allowing the entire existing radio network to be gracefully upgraded, wherein the upgrades can be performed to the locomotive radio systems and the wayside radios systems independent of one another. In accordance with the present invention, the digital messaging system may also be configured into a variety of configurations capable of implementing the method of the present invention, wherein two (2) of these configurations are discussed in greater detail hereinafter. The first configuration is referred to as an "analog plus digital" configuration and the second configuration is referred to as a "digital with analog" configuration. The first configuration, i.e. the "analog plus digital" configuration, is considered to be the simplest system to implement and is intended to have the digital messaging used in conjunction with the analog voice system on every broadcast (or on selected broadcasts). For this configuration, the wayside radio does not need to make a positive identification with a passing train. Instead, an analog and digital message is broadcast, with the analog message being broadcast first and the digital message being broadcast shortly thereafter. This allows the train crew to hear the broadcast as they typically would, but also gives a digitally capable train crew the ability to receive and/or transmit digital data via a digital locomotive radio, thus allowing the message to be displayed and/or stored in the on-board radio.

The second configuration, i.e. the "digital with analog" configuration, is a system that is configured for primarily digital messaging, but that can handle analog voice messaging when required to support trains that are not equipped for digital communications. To implement digital messaging with a mix of trains that are not all capable of receiving digital information, the wayside defect detector system, namely the wayside digital radio, must "know" whether a passing train is capable of digital communications. To successfully determine this, the wayside digital radio may identify the passing train in a variety of ways as discussed in more detail hereinafter. In this configuration, when a passing train is detected by the wayside defect detector system, the wayside defect detector system queries the train and identifies whether the train is equipped for digital messaging. If the train is equipped for digital messaging, the wayside digital radio will inhibit any transmission requests by the wayside defect detector system and not pass on any modulation input from the wayside defect detector system. The wayside digital radio will encode and send the digital message it receives from the wayside defect detect system to the on-board digital radio. The on-board digital radio will acknowledge receipt of the digital transmission to the wayside digital radio and if the message was received without error, communication will be terminated/continued.

However, if there was an error in the received data, the on-board digital radio will request that the wayside digital radio resend the data message transmission. In the event the wayside digital radio does not get a correct acknowledgement of the data transmission, the wayside digital radio will log an error and send an error message to the wayside defect detector system and/or provide a hardware signal indication that an error has occurred. If the train is not equipped for digital messaging or if the train does not respond to the initial query by the wayside digital radio, the wayside digital radio will allow normal analog transmissions to be made between the wayside defect detector system and the on-board train radio.

It should be appreciated that although several methods for identifying whether a passing train is equipped with digital messaging capability exist, any method and/or device suitable to the desired end purpose may be used. For example, one method for identifying whether a train is equipped with digital messaging capability involves requiring the train crew to acknowledge a query transmitted by the wayside digital radio. In this case, the wayside digital radio may initiate a query by transmitting one part of a "handshake" message that would be displayed on a digitally equipped train radio. If the train does not have a digitally equipped radio, the message is not displayed and therefore cannot be acknowledged by the on-board train crew. In this case, the wayside defect detector messaging will be done via traditional analog broadcasts. However, if the train is digital message capable, then the on-board train crew will see the message and reply with the remaining half of the "handshake" message. If the wayside digital radio receives the proper response from the on-board digital radio, the wayside digital radio will inhibit any analog transmissions and only make digital message transmissions.

Another method for identifying whether a train is equipped with digital messaging capability involves using Identification (ID) Tags that can be read by remote scanners (i.e. tag readers). In this case, when the wayside defect detection system has detected a train, the train ID information is read from an ID tag that is disposed on the train and the train identification information is passed on to the wayside digital radio. The wayside digital radio then sends a query using the train ID information in its digital message. If the train does not have a digitally equipped radio, the message is not understood, so it cannot acknowledge the query. As such, the defect detector messaging will be performed via traditional analog broadcasts. However, if the train is digital message enabled, the crew will identify the train ID information as their train and make the appropriate response via the on-board digital radio. When the wayside digital radio receives the correct acknowledgement to its query, it will inhibit any analog transmissions and only make digital message transmissions.

Still yet another method for identifying whether a train is equipped with digital messaging capability involves the automatic identification of the train using the aforementioned train ID tag. This method is similar to that discussed hereinabove, but eliminates the crewmember from having to manually acknowledge the query from the wayside digital radio. It should be appreciated that this identification method could be used to identify a train via a location, a direction and/or a speed using a Global Positioning System (GPS). For example, assume that the on-board digital radio includes a GPS receiver or has access to GPS information for the train. Further, assume that the wayside digital radio has GPS information for its own location. In this case, when a train is detected, the wayside digital radio initiates a query to the passing train, wherein the query may contain the GPS coordinates for the wayside digital radio (i.e. the query asks the train if it is the train that just passed the location identified by the GPS coordinates given). If the train does not have a digitally equipped radio, the message is not understood, so it cannot acknowledge the query, which means that defect detector messaging will be done via traditional analog broadcasts. However, if the train does have a digitally equipped radio, the on-board digital radio will compare the location coordinates sent in the query with the current coordinates received by the GPS system. If there is a match (within a certain margin of error), the on-board digital radio will acknowledge the query. If the coordinates do not match (within a certain margin of error), then the on-board digital radio will not acknowledge the transmission. If the wayside digital radio receives a proper acknowledgement to the query it sent, all analog messages will be inhibited and replaced with digital messages.

Furthermore, if operating in dual track territory and the GPS coordinates are not accurate enough to distinguish which track the train is traveling on, the wayside digital radio may be used to supply train direction and train speed, as may be determined by the wayside equipment, along with the wayside GPS location coordinates to further identify the train. Consequently, the on-board radio may also be used to determine the train speed and direction from the train GPS system and may be used to validate the query from the wayside digital radio. This could be useful in the situation where two (2) trains are passing the wayside defect detection system and the GPS coordinates are not accurate enough to distinguish one train from the other. In this case, knowing the speed and/or direction of the travel of the train would allow the wayside defect detection system identify one train from another.

Referring again to FIG. 5, a first embodiment of a digital messaging system 500 is shown and includes a wayside detection system 502 communicated with an on-board voice radio 504 via an on-board digital radio interface 506 to allow for the transfer of data between the wayside detection system 502 and the on-board voice radio 504. It should be appreciated that the wayside detection system 502 may include at least one sensing device 508 which communicates sensor data to the wayside detection system 502, wherein the sensor data may be communicated to the wayside detection system 502 in analog format and then converted to a digital format via the wayside detection system 502 and/or the sensor data may be communicated to the wayside detection system 502 in digital format. Additionally, the wayside detection system 502 may be communicated with the on-board voice radio 504 via the digital radio interface 506 using any communications method suitable to the desired end purpose, such as a serial communications and/or a parallel communications. It should be appreciated that the present invention contemplates that the digital data and/or the analog data being broadcasted may be checked for errors to insure complete and/or correct data transfer.

It should be appreciate that the digital radio interface 506 may allow for the on-board voice radio 504 to be upgraded for digital communication. For example, the existing on-board voice radio 504 may be retrofitted with a digital modem using specialized data protocols to allow receipt and display of messages from the wayside detection system 502. Once the digital messages have been received by the existing on-board voice radio 504 from the wayside detection system 502, the digital messages may be displayed to the on-board train crew via a digital display 600 (See FIG. 6) and/or the digital messages may be enunciated to the on-board train crew via a voice message over the radio speaker.

The present invention contemplates that the wayside detection system 502 may provide the on-board digital radio 506 with the information that needs to be broadcast to the train in a formatted text message. For example, the information broadcast to the train may include information that is to be broadcast to the on-board train crew and that is to be stored in a memory location for future download, wherein the desired action by the on-board digital radio may be triggered by predetermined keywords. For example, consider the situation where the wayside detection system 502 broadcasts information to a passing train, wherein the information includes wayside equipment information, train information and other information not necessarily important to the on-board crew members. When the portion of the broadcasted information that needs to be communicated to the on-board crew is identified, a keyword is inserted into the message, wherein the keyword is recognized by the on-board digital radio. When the on-board digital radio recognizes the keyword, the on-board digital radio may digitally packetize the information associated with that keyword. The digital packet(s) may then be checked for errors and communicated to the on-board crew members.

Referring again to FIG. 7, a second embodiment of a digital messaging system 700 is shown and includes a wayside detection system 702 directly communicated with an on-board digital radio 704 to allow for the transfer of data between the wayside detection system 702 and the on-board digital radio 704. As above, it should be appreciated that the wayside detection system 702 may include at least one sensing device 706 which communicates sensor data to the wayside detection system 702. The sensor data may be communicated to the wayside detection system 702 in analog format and then converted to a digital format via the wayside detection system 702 and/or the sensor data may be communicated to the wayside detection system 702 in digital format. The wayside detection system 702 may be communicated with the digital radio 704 via any communications method suitable to the desired end purpose, such as a serial communications and/or a parallel communications. It should be appreciated that the digital communications allow for the digital data to be checked for errors to insure complete and/or correct data transfer. Once the digital messages have been received from the wayside detection system 702, the digital messages may be displayed to the on-board train crew via a digital display 600 (See FIG. 6) and/or the digital messages may be enunciated to the on-board train crew via a voice message over the radio speaker.

Figure 8:
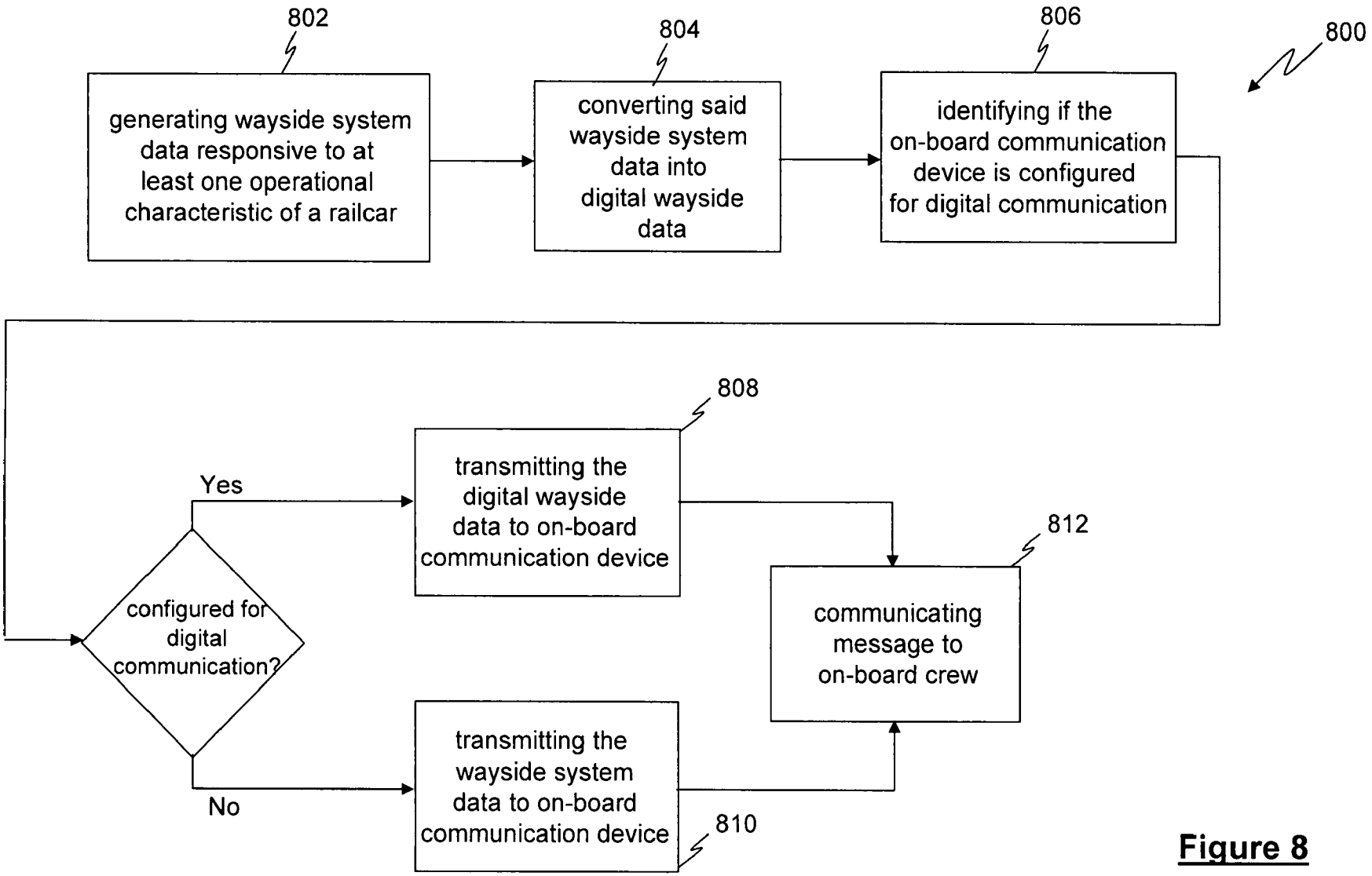
FIG. 8 is a block diagram illustrating a method for monitoring the operational status of a railcar moving along a railroad track using the defect detection system of the present invention.

Referring to FIG. 8, a block diagram describing a method 800 for monitoring an operational characteristic of a railcar moving along a railroad track is shown. As discussed hereinabove, the wayside monitoring system generates data responsive to at least one operational characteristic of a passing railcar, as shown in operational block 802, wherein the data may include alarm status, train information, and/or sensor data. It should be appreciated that this alarm status, train information, and/or sensor data may be generated as digital data, ascii text, and/or may be analog data that has been converted into digital data. Also, the sensor data may include data responsive to any detectable condition and/or characteristic of a passing train, such as hot wheel data and/or hot bearing data. The generated data may then be converted into digital data, as shown in operational block 804. As discussed in greater detail hereinbefore, a query of the on-board digital radio is then conducted by the wayside digital radio to identify if the passing train is equipped for digital communications, as shown in operational block 806. If the train is equipped for digital communications, then the wayside digital radio then transmits the alarm status, train information, and/or sensor data to the on-board digital radio of the passing train via the dispatch voice channel, as shown in operational block 808. It should be appreciated that if the train is not equipped for digital communications, then only analog voice transmission will occur via the dispatch voice channel, as shown in operational block 810. Once the on-board digital radio has received the transmitted alarm status, train information, and/or sensor data, the alarm status, train information, and/or sensor data is communicated to the on-board crew members, as shown in operational block 812. As discussed hereinbefore, this may be accomplished by displaying the digital data via a digital display device and/or by enunciating the data messages over the digital radio speaker.

It should be appreciated that the alarm status may include any alarm status information available suitable to the desired end purpose such as Hot Journal Alarm and/or Dragging Equipment Detected Alarm. Additionally, the train information may include any type of information desired, such as train location/direction/velocity information, railway/train property information, railway/train safety information, railway/train warning information and/or any other type of information the railroad chooses to transmit with the defect detector equipment. Furthermore, sensor data may include any type of sensor data, sensor related data or sensor equipment related data suitable to the desired end purpose. For example, sensor data may include individual wayside sensor data from sensors disposed along or in the vicinity of the rails.

It should be appreciated that the digital sensor data may include, but not be limited to, a physical characteristic data of the wheel assembly such as temperature data for the entire wheel assembly and/or a single component of the wheel assembly (i.e. bearing temperature, brake temperature, etc.). Moreover, the digital sensor data may also include, but not be limited to, wheel assembly data regarding the number and/or location of the wheel assembly with respect to the train and/or a specific railcar. As discussed hereinbefore, the vehicle and the wheel assemblies may be identified by employing an identification tag which would be disposed adjacent each and/or selected wheel assemblies. In this case, as the railcar passes by the wayside detection system, the identification tag could be 'read' by the wayside detection system, wherein the identification tag may communicate the wheel assembly identification data to the wayside detection system. This information may then be communicated to the on-board crewmembers or to a central office.

At least one of wayside detection system and the on-board digital radio may be communicated with a remote device to allow the digital sensor data to be communicated to a remote site, such as a central office. This would allow the central office personnel to communicate to off-site personnel that a problem has occurred, the location of the particular railcar experiencing the problem and which component has experienced the problem, greatly enhancing diagnostic and operational awareness of the operational condition of the railcars in the train. Furthermore, all or only a portion of the generated sensor data may be in digital format. Although it is possible that one or all of the elements of wayside detection portion may generate analog data, it should be appreciated that this analog data may be at least partially converted to digital data before being communicated. It should be appreciated that the at least one monitoring element may include any sensing devices suitable to the desired end purpose, such as hot bearing and hot wheel detectors, vertical and horizontal wheel load (or impact) detectors, drag detectors and high wide detectors.

In accordance with an exemplary embodiment, the processing of at least a portion of the method in FIG. 8 may be implemented by a controller disposed internal, external or internally and externally to a digital messaging system. In addition, processing of at least a portion of the method in FIG. 8 may be implemented through a controller operating in response to a computer program. In order to perform the prescribed functions and desired processing, as well as the computations therefore (e.g. execution control algorithm(s), the control processes prescribed herein, and the like), the controller may includes, but not be limited to, a processor(s), computer(s), memory, storage, register(s), timing, interrupt(s), communication interface(s), and input/output signal interface(s), as well as combination comprising at least one of the foregoing.

Additionally, the method in FIG. 8 may be embodied in the form of a computer or controller implemented processes. The method in FIG. 8 may also be embodied in the form of computer program code containing instructions embodied in tangible media, such as floppy diskettes, CD-ROMs, hard drives, and/or any other computer-readable medium, wherein when the computer program code is loaded into and executed by a computer or controller, the computer or controller becomes an apparatus for practicing the methods. The method of FIG. 8 can also be embodied in the form of computer program code, for example, whether stored in a storage medium, loaded into and/or executed by a computer or controller, or transmitted over some transmission medium, such as over electrical wiring or cabling, through fiber optics, or via electromagnetic radiation, wherein when the computer program code is loaded into and executed by a computer or a controller, the computer or controller becomes an apparatus for practicing the invention. When implemented on a general-purpose microprocessor the computer program code segments may configure the microprocessor to create specific logic circuits.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A communication system for communicating information between wayside equipment and a passing rail vehicle, wherein the communication system comprises:

a wayside monitoring system located at a wayside of a railway, wherein said wayside monitoring system generates wayside system data; and a wayside communication device communicated with said wayside monitoring system to receive said wayside system data, wherein said wayside communication device generates digital wayside data based on the wayside system data, queries the passing rail vehicle to determine if the passing rail vehicle is equipped for digital communication, and transmits said digital wayside data to the passing rail vehicle via a dispatch voice channel, wherein said wayside monitoring system includes at least one wayside sensing device for sensing at least one operational characteristic of the passing rail vehicle, and wherein said at least one wayside sensing device is communicated with said wayside communication device.

2. The communication system of claim 1, wherein said at least one wayside sensing device includes at least one of a hot bearing sensor, a hot wheel sensor, a dragging equipment sensor, a high load sensor, a wide load sensor, a high water sensor and a falling rock sensor.

3. The communication system of claim 1, wherein said wayside communication device is configured for transmitting data in a digital format and an analog format via said dispatch voice channel.

4. The communication system of claim 1, wherein the system further comprises an on-board communication device is configured for receiving data in a digital format and an analog format via said dispatch voice channel.

5. The communication system of claim 1, further comprising an on-board communication device that includes a digital radio interface for receiving said digital wayside data from said wayside communication device via said dispatch voice channel.

6. The communication system of claim 1, wherein the wayside communication device is configured to transmit the wayside system data to the passing rail vehicle in an analog format over the dispatch voice channel, and wherein an on-board communication device includes an analog radio interface for receiving said wayside system data from said wayside communication device via said dispatch voice channel.

7. The communication system of claim 1, wherein an on-board communication device is communicated with a digital announcement device for communication of said digital wayside data to on-board crewmembers.

8. The communication system of claim 7, wherein said digital announcement device is at least one of a digital display device and an audio device.

9. The communication system of claim 1, wherein said digital wayside data is transmitted in a digital format when the rail vehicle is determined to be equipped for digital communication.

10. The communication system of claim 1, wherein said digital wayside data is transmitted in an analog format when the rail vehicle is determined to not be equipped for digital communication.

11. A communication system for communicating information between a wayside monitoring system and a rail vehicle traveling on a railway, wherein the wayside monitoring system generates analog wayside system data responsive to an operational characteristic of the rail vehicle, wherein the communication system comprises:

a wayside communication device communicated with said wayside monitoring system to receive the analog wayside system data, wherein said wayside communication device generates digital wayside data responsive to the analog wayside system data, queries the rail vehicle to determine if the rail vehicle is equipped for digital communication, and transmits said digital wayside data via a dispatch voice channel; and an on-board communication device on the rail vehicle, wherein said on-board communication device receives said digital wayside data via said dispatch voice channel.

12. The communication system of claim 11, wherein said digital wayside data is transmitted in a digital format when the rail vehicle is determined to be equipped for digital communication.

13. The communication system of claim 11, wherein said digital wayside data is transmitted in an analog format when the rail vehicle is determined to not be equipped for digital communication.

* * * * *